United States Patent [19]

Bridgeman

[11] 4,364,496

[45] Dec. 21, 1982

[54] COAT HANGER

[76] Inventor: Bruce B. Bridgeman, 8404 N. Shore Blvd., Marblehead, Ohio 43440

[21] Appl. No.: 185,242

[22] Filed: Sep. 8, 1980

[51] Int. Cl.[3] ..... A47J 51/08

[52] U.S. Cl. ..... 223/88; 223/DIG. 3; 223/92; 211/113; 211/117

[58] Field of Search ..... 223/85, 88, 89, 92, 223/DIG. 3, DIG. 4, 94; 211/117, 119, 113, 118; D6/247, 250, 256

[56] References Cited

U.S. PATENT DOCUMENTS

| | | | |
|---|---|---|---|
| D. 123,394 | 11/1940 | Dunlap | D6/247 |
| D. 159,538 | 8/1950 | Savran | D6/248 |
| D. 183,426 | 8/1958 | Hale | D6/248 |
| D. 229,775 | 1/1974 | Carroll | D6/85 |
| D. 234,243 | 2/1975 | Lindemann | D6/85 |
| 341,022 | 5/1886 | Krull | 223/88 |
| 680,168 | 8/1901 | Norris | 223/92 |
| 1,336,849 | 4/1920 | McCaffrey | 223/88 |
| 1,644,200 | 10/1927 | Ovenshire | 223/88 |
| 2,151,621 | 3/1939 | Silverman | 223/88 |
| 2,354,099 | 7/1944 | Bess | 223/86 |
| 2,465,576 | 3/1949 | Colburn | 223/89 |
| 2,645,357 | 7/1953 | Taylor et al. | 211/117 |
| 2,690,863 | 10/1954 | Adelman | 223/81 |
| 2,710,489 | 6/1955 | Myers | 40/322 |
| 2,747,746 | 5/1956 | Laughton | D6/247 UX |
| 2,977,001 | 3/1961 | Vitale | 211/113 |
| 3,180,544 | 4/1965 | Magiera | 223/81 |
| 3,451,601 | 6/1969 | Pelavin et al. | 223/85 |
| 3,703,978 | 11/1972 | Sammertino | 223/89 |
| 4,040,545 | 8/1977 | Hill | 223/85 |
| 4,058,222 | 11/1977 | Singer | 223/92 |

FOREIGN PATENT DOCUMENTS

| | | | |
|---|---|---|---|
| 63349 | 2/1914 | Austria | 223/92 |
| 274114 | 10/1902 | France | 223/89 |
| 674400 | 10/1929 | France | 223/92 |
| 35138 | 6/1922 | Norway | 223/88 |

*Primary Examiner*—Robert Mackey

*Attorney, Agent, or Firm*—Emch, Schaffer & Schaub

[57] ABSTRACT

The present invention discloses a hanger having an elongated shaft with a hook located on each end of the shaft. A flange is positioned on the elongated shaft and the flange extends radially outward from the shaft. A keying means is positioned on the shaft adjacent to the flange. A garment supporting portion is positioned on the shaft. The garment supporting portion defines an aperture in which the shaft is positioned. The aperture has a configuration that mates with the keying means on the shaft. The flange acts to retain the keying means on the shaft in alignment with the aperture.

8 Claims, 6 Drawing Figures

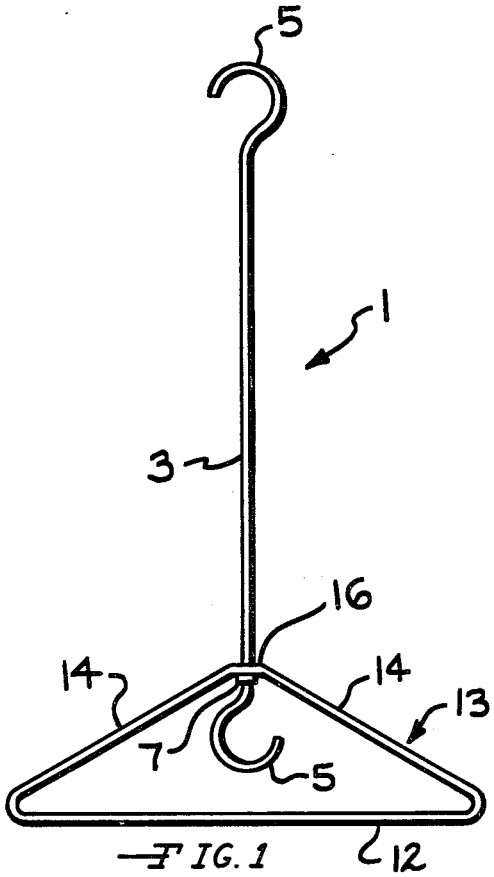
FIG. 1
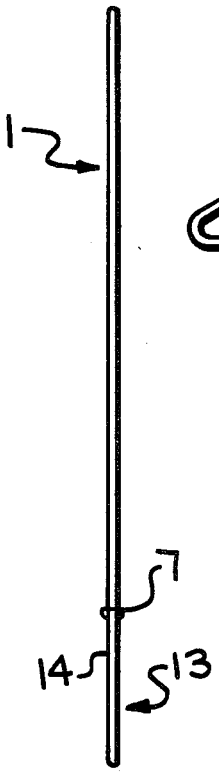
FIG. 2
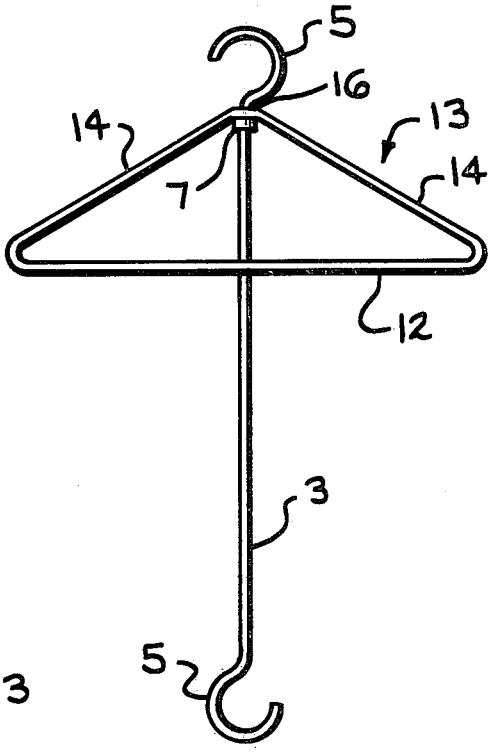
FIG. 3
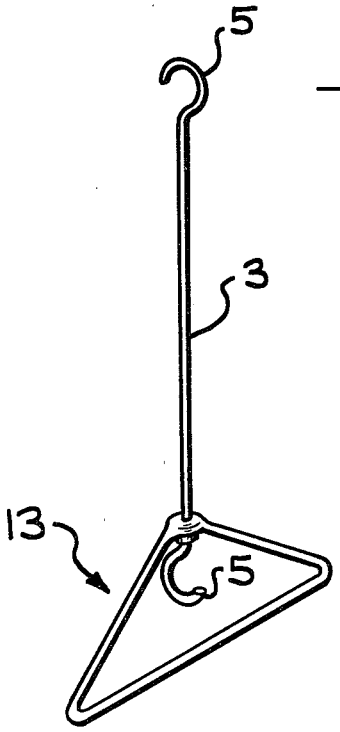
FIG 4
FIG. 5
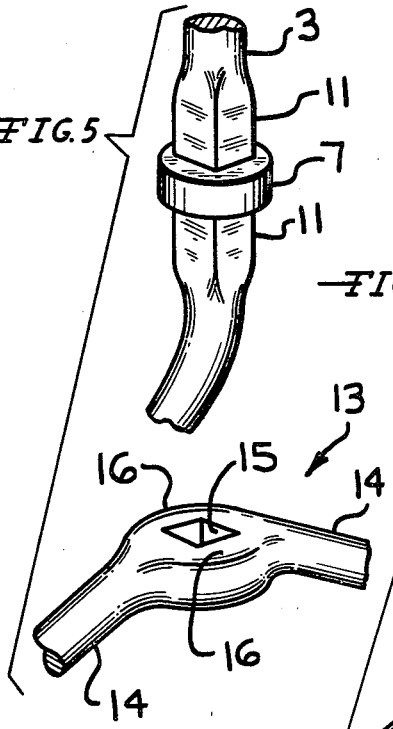
FIG. 6
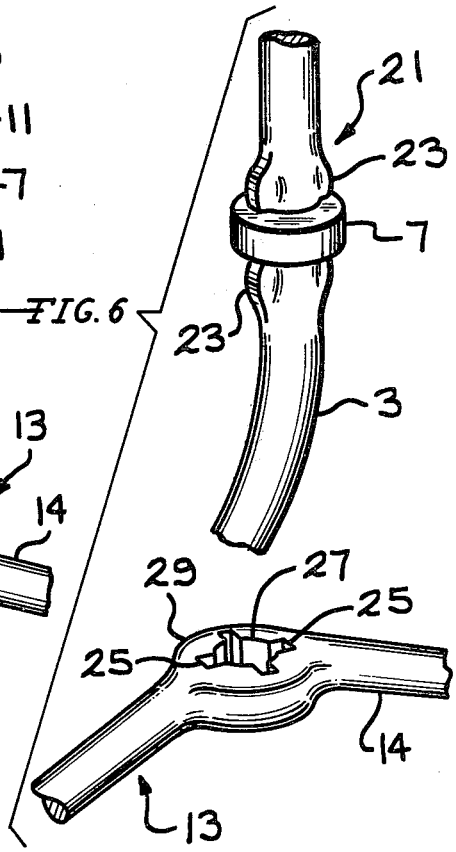

COAT HANGER

BACKGROUND OF THE INVENTION

This invention is directed to a hanger having a hook that is removably attached to a triangular base. More specifically the invention is directed to a hanger having an elongated shaft with a hook located at each end that is removably positioned on a triangular garment supporting base.

Garment hangers are a commonly used household item. Normally such hangers are formed from a single piece of wire and comprise a substantially triangular portion having a hook securely attached to the triangular portion. Garments that are to be hung are positioned on the triangular portion of the hanger and the hook is positioned on a rod or other suitable hanging means. In some applications, these prior art hangers are not well suited for the intended use and the hangers are not easily or effectively modified.

Children and relatively short people are frequently not tall enough to position the hook of the hanger on the rod or other hanging means that is provided for supporting the hanger. In this situation, it would be desirable to have a hanger having an elongated neck that would allow a smaller individual to position the hook on the support rod. This would be particularly advantageous in teaching small children to hang up their clothes. It would also be desirable to be able to convert the hanger to one having the normal relationship between the triangular base and the hook when the hanger is not being used by children or other relatively short individuals.

There are also instances when the hooks on prior art hangers are not in the proper plane for hanging the hanger on a support device. In this instance, it would be desirable to have a hanger where the hook is capable of being positioned in different planes with respect to the triangular base.

SUMMARY OF THE INVENTION

The present invention discloses a hanger having an elongated shaft with a hook located on each end of the shaft. A flange is positioned on the elongated shaft and the flange extends radially outward from the shaft. A keying means is positioned on the shaft adjacent to the flange. A garment supporting portion is positioned on the shaft. The garment portion defines an aperture in which the shaft is positioned. The aperture has a configuration that mates with the keying means on the shaft. The flange acts to retain the keying means on the shaft in alignment with the aperture.

It is an object of this invention to provide an improved hanger.

Another object of the invention is to provide a hanger that is readily adjustable.

Other objects and advantages of the invention will become apparent from the following detailed description of the invention with reference to the accompanying drawings.

BRIEF DESCRIPTION OF THE DRAWINGS

FIG. 1 is a front elevation view of the hanger of the present invention.

FIG. 2 is a side elevation view of the hanger of the present invention.

FIG. 3 is a front elevation view of another embodiment of the hanger of the present invention.

FIG. 4 is a perspective view of the hanger of the present invention.

FIG. 5 is an enlarged partial perspective view of the keying means used in the hanger of the present invention.

FIG. 6 is an enlarged partial perspective view of another embodiment of a keying means that can be used in the hanger of the present invention.

DESCRIPTION OF THE PREFERRED EMBODIMENT

This invention relates to a hanger having a hook that is removably attached to a base upon which clothes may be hung. Features of this invention will be more fully understood by referring to the attached drawings in connection with the following description.

FIGS. 1, 2 and 5 show one embodiment of a hanger 1 of the invention. The hanger has an elongated, cylindrical shaft 3 having a hook 5 located at each end of the elongated shaft. A flange 7 is positioned on the shaft adjacent one of the hooks on one end of the shaft. The flange 7 extends from the shaft in a direction that is substantially perpendicular to the longitudinal axis of the shaft.

As is best shown in FIG. 5, keying means 11 are disposed on the shaft 3 on each side of the flange 7. The keying means have a substantially square cross section and a circumference that is larger than the circumference of the remainder of the shaft 3.

A garment supporting portion 13 is positioned on the shaft 3. The garment supporting portion is usually substantially triangular in shape and has a base 12 and two side walls 14. The side walls 14 are joined together at an apex 16. The triangular portion 13 defines an aperture 15 in the apex 16 that is large enough to receive the shaft 3. The configuration of the aperture 15 is such that it will mate with the keying means 11 located on the shaft 3. The flange 7 is in contact with the apex 16 of the triangular portion 13 in the area of the aperture 15 and the flange 7 acts to locate the triangular portion 13 on the shaft 3. The flange 7 and keying means 11 are normally located on the shaft adjacent one of the hooks 5. As shown in FIG. 1, the triangular garment supporting portion 13 has been positioned on the shaft 3 so that the elongated shaft 3 extends from the triangular base portion. Although the garment supporting portion has been described as being substantially triangular it should be recognized that other configurations for the garment supporting portion can be used with the present invention.

To assemble the hanger, the garment portion 13 is positioned on the shaft 3. The hook 5 and shaft 3 are advanced through the aperture 15 until the keying means 11 on the shaft 3 is matingly engaged with the aperture 15. The elongated shaft will be advanced through the aperture 15 in a direction so that the flange 7 will engage the apex 16 of the garment portion 13 in the area of the aperture 15. The flange 7 is positioned to engage the epex 16 of the triangular garment portion on the interior of the garment portion. In this manner, the flange 7 will act as a stop or positioning means to retain the triangular garment portion 13 in a predetermined position on the shaft 3. In FIG. 1, the elongated shaft 3 has been positioned in the aperture 15 so that one hook 5 is positioned in the interior of the triangular garment portion 13. The elongated shaft 3 extends from the triangular portion 13 so that the other hook 5 is spaced apart from the triangular garment portion 13 by the length of the shaft 3.

FIG. 3 shows another embodiment of the hanger 1 where the position of the elongated shaft 3 has been reversed from that shown in FIG. 1. In this embodiment, the hook 5 adjacent the flange 7 is immediately adjacent the triangular garment portion 13. The elongated shaft 3 extends in a direction towards the interior of the triangular portion. Thus, the hook 5 on the other end of the elongated shaft 3 will be positioned in spaced apart relationship from the base 12 of the triangular portion 13.

FIG. 4 shows the hanger of FIG. 1 where the elongated shaft has been rotated 90° C. from the position shown in FIG. 1. In this position, the keying means 11 on the elongated shaft 3 has been rotated 90° in the aperture 15. In this position, the hooks 5 on the elongated shaft 3 will be in a plane that is perpendicular to the plane formed by the triangular portion 13.

FIG. 6 shows another embodiment of a keying means that can be used with a hanger of this invention. In this embodiment, the keying means 21 is comprised of protrusions 23 that extend from the elongated shaft 3 on each side of the flange 7. The protrusions 23 mate with grooves 25 formed in the aperture 27 located in the apex 29 of the triangular portion 13. The keying means 21 and elongated shaft 3 are positioned in the aperture 27 of the triangular portion 13 in substantially the same manner as previously described to assemble the hanger of this embodiment.

The hanger of this invention provides a hanger that is adaptable for a variety of uses. As shown in FIG. 1, the hook 5 is spaced apart from the triangular portion 13 by the length of the elongated shaft 3. In this embodiment, the triangular portion 13 will be at a much lower position when the hook 5 is positioned on a rod or other suitable hanging means. This position for the triangular garment portion 13 more readily allows a child or a relatively small individual to utilize the hanger to hang garments.

To position the triangular garment portion 13 at its normal position with respect to the hook 5, the elongated shaft can be reversed so that a hook 5 is immediately adjacent the apex 16 of the triangular portion 13, as shown in FIG. 3. The hanger 1 can be easily modified by removing the elongated shaft 3 from the triangular portion 13 and then repositioning the elongated shaft in the desired position in the aperture 15.

Also as shown in FIG. 4, the orientation of the hooks 5 with respect to the garment portion 13 can be altered by changing the position of the keying means 11 in the aperture 15. It should be noted that the keying means 11 can be designed to allow the elongated shaft 3 and hooks 5 to be positioned in almost any angular relationship to the garment portion 13.

It is also possible to use the elongated shaft 3 individually as a hanger. In this application one hook 5 on the elongated shaft 3 is positioned on a rod or other suitable hanging means. The other hook 5 will extend down from the rod and be in a position where clothes can be positioned on the hook. The elongated shaft will position the other hook in a position where the hook can be reached by a child or a relatively small individual. This simplified hanger will be particularly useful in teaching a child to hang up garments. Once the child masters using the hook to hang up garments, the triangular garment supporting portion 13 can be positioned on the elongated shaft to form a traditional hanger.

Having described the invention in detail and with reference to the drawings, it will be understood that such specifications are given for the sake of explanation. Various modifications and substitutions other than those cited can be made without departing from the scope of the invention as defined by the following claims.

What I claim is:

1. A hanger for hanging on a support surface comprising:

an elongated shaft having a first hook located on one end of said shaft and a second hook located on the other end of said shaft, said first and second hooks constructed for selectively engaging said support surface;

a single flange positioned on said shaft and extending radially outward from said shaft, said flange being positioned substantially adjacent one end of said shaft and adjacent said first hook;

keying means positioned on said shaft adjacent to said flange, said keying means including a first keying means positioned adjacent said side of said flange that faces said first hook and a second keying means that is positioned adjacent said side of said flange that faces said second hook; and a garment supporting portion removably positioned on said shaft, said portion defining an aperture for receiving said shaft, said aperture having a configuration that mates with said keying means on said shaft, said aperture mating with said first keying means when said first hook is used to support said hanger on said support member and said aperture mating with said second keying means when said second hook is used to support said hanger on said support member, said flange retaining said portion in alignment with said keying means on said shaft whereby said aperture of said garment supporting portion can be positioned in engagement with said first keying means to position said garment supporting portion adjacent said first hook and whereby said aperture of said garment supporting portion can be positioned in engagement with said second keying means to position said garment supporting portion in spaced apart relationship with said second hook, whereby the position of said garment supporting portion with respect to said support surface can be varied.

2. The hanger of claim 1 wherein said keying means has a substantially square cross section.

3. The hanger of claim 2 wherein said aperture in said garment supporting portion has a substantially square cross section.

4. The hanger of claim 1 wherein said flange engages said garment supporting portion in the region of said aperture in said portion.

5. The hanger of claim 1 wherein said garment supporting portion has a substantially triangular shape.

6. The hanger of claim 1 wherein said keying means includes at least one protrusion that projects from the sides of said shaft.

7. The hanger of claim 6 wherein said aperture in said garment supporting portion contains grooves that matingly engage the protrusions on said keying means.

8. A hanger for hanging on a support rod comprising:

an elongated shaft having a first end and a second end, a first hook positioned on the first end of said shaft and a second hook positioned on said second end of said shaft, said first and second hooks constructed to selectively engage said support rod to support said hanger;

a single substantially circular flange securely positioned on said shaft and extending radially outward from said shaft, said flange being substantially adjacent said first end of said shaft and said first hook, a first keying means positioned on said shaft adjacent said side of said flange that faces said first hook, said first keying means having a substantially square cross section that extends beyond the outer periphery of said shaft;

a second keying means positioned on said shaft adjacent said side of said flange that faces said second hook, said second keying means having a substantially square cross section that extends beyond the outer periphery of said shaft;

a substantially triangular shaped garment supporting portion, said garment supporting portion defining an aperture having a substantially square cross section that can matingly engage said first or second keying means, said aperture being disposed for removably engaging said first or second keying means on said shaft to position said garment supporting portion on said shaft, said aperture mating with said first keying means when said first hook is used to support said hanger on said support rod and said aperture mating with said second keying means when said second hook is used to support said hanger on said support rod, said flange engaging said garment supporting portion adjacent said aperture to maintain said aperture in engagement with said keying means on said shaft whereby said aperture of said garment supporting portion can be positioned in engagement with said first keying means to position said garment supporting portion adjacent said first hook and whereby said aperture of said garment supporting portion can be positioned in engagement with said second keying means to position said garment supporting in spaced apart relationship with said second hook, said garment supporting portion being spaced apart from said second hook by the length of said shaft between said flange and said second hook, whereby the position of said garment supporting portion with respect to said support rod can be varied.

* * * * *